US007044805B1

(12) United States Patent
Huang

(10) Patent No.: US 7,044,805 B1
(45) Date of Patent: May 16, 2006

(54) PIN CONTACT INSTALLATION ASSEMBLY FOR A TERMINAL

(76) Inventor: Huang-Chou Huang, No. 59, Sec. 1, Jiow Juang St., Nankang Dist., Taipei (TW)

( * ) Notice: Subject to any disclaimer, the term of this patent is extended or adjusted under 35 U.S.C. 154(b) by 0 days.

(21) Appl. No.: 10/970,919

(22) Filed: Oct. 22, 2004

(51) Int. Cl.
*H01R 24/00* (2006.01)

(52) U.S. Cl. ..... 439/676; 439/885

(58) Field of Classification Search ..... 439/676, 439/885

See application file for complete search history.

(56) References Cited

U.S. PATENT DOCUMENTS 5,060,372 A * 10/1991 Capp et al. ..... 29/883
5,152,700 A * 10/1992 Bogursky et al. ..... 439/733.1
5,417,589 A * 5/1995 Terada ..... 439/590
5,452,512 A * 9/1995 Foley et al. ..... 29/874
6,139,377 A * 10/2000 Chen ..... 439/885

* cited by examiner

*Primary Examiner*—Truc Nguyen
(74) *Attorney, Agent, or Firm*—Alan D. Kamrath; Nikolai & Mersereau, P.A.

(57) ABSTRACT

A pin contact installation assembly for a terminal has a pin contact tree and multiple pin contacts. The pin contact tree has multiple tabs formed integrally with each other and arranged abreast and multiple longitudinal posts. Each pin contact has a contact lead formed with and extending from a corresponding longitudinal post and a pin socket. Each pin socket comprises a limit, an upper clamp and a lower clamp. The limit is formed on the contact lead, and the upper and lower clamps are formed on the limit. The pin contacts can be assembled easily with a terminal bracket assembly to fabricate a terminal, which saves time during assembly of the terminal.

2 Claims, 4 Drawing Sheets

PIN CONTACT INSTALLATION ASSEMBLY FOR A TERMINAL

BACKGROUND OF THE INVENTION

1. Field of the Invention

The present invention relates to an installation assembly, and more particularly to pin contact installation assemblies for a terminal that facilitates assembly of the terminal.

2. Description of Related Art

Terminals such as universal serial bus (USB) ports are mounted generally on a printed circuit board (PCB) such as a motherboard or expansion board inside a computer and are connected electrically to peripherals such as printers or monitors. The terminals allow data and control signals to be transmitted between the computer and the peripherals.

With reference to FIG. 4, a conventional terminal has a terminal bracket (60), multiple three pin contact installation assemblies (70) and multiple two pin contact installation assemblies (80).

The terminal bracket (60) has a front, a back, a row of upper holes (61), a row of medial holes (62) and a row of lower holes (63). The upper holes (61) are defined through the terminal bracket (60) and are arranged abreast at intervals. The medial holes (62) are defined through the terminal bracket (60) below the upper holes (61) and are arranged abreast at intervals. The lower holes (63) are defined through the terminal bracket (60) below the medial holes (62) and are arranged abreast at intervals.

The three pin contact installation assemblies (70) are installed in the back of the terminal bracket (60) and have three pin sockets arranged abreast at intervals and extending respectively into alternate upper, medial or lower holes (61, 62, 63) in the same row. Each pin socket on the three pin contact installation assemblies (70) has two vertical sides and a U-shaped cross-section.

The two pin contact installation assemblies (80) are installed in the back of the terminal bracket (60) and correspond to the three pin contact installation assemblies (70). Each two pin contact installation assembly (80) has two pin sockets arranged abreast at intervals, extending respectively into alternate upper, median or lower holes (61, 62, 63) in the same row and located between adjacent pin sockets of the three pin contact installation assemblies (70). Each pin socket of the two pin contact installation assemblies (80) has two vertical sides and a U-shaped cross-section.

The three or two pin contact installation assemblies (70, 80) are manufactured by molding or stamping the whole body of the three or two pin contact installation assemblies (70, 80). Then the sides of each pin socket are bent to make the U-shaped cross-section conform to the holes (61, 62, 63), and each pin socket is bent to align with the holes (61, 62, 63). However, bending the sides of the pin sockets necessitates making two complementary installation assemblies with pin contacts (70, 80) with pin sockets that mount in alternate rather than adjacent holes (61, 62, 63) in the same row. Installation of the installation assemblies with three and two pin contacts (70, 80) into each row of holes (61, 62, 63) of the terminal bracket (60) comprises two identical processes. Therefore, assembling the terminal is inefficient and time-consuming.

To overcome the shortcomings, the present invention provides pin contact installation assemblies for a terminal to mitigate or obviate the aforementioned problems.

SUMMARY OF THE INVENTION

The main objective of the invention is to provide pin contact installation assemblies for a terminal, which have multiple pin sockets for installation in adjacent through holes in a terminal bracket of the terminal. Assembly of the terminal is efficient and saves time.

Pin contact installation assemblies for a terminal in accordance with the present invention comprise a pin contact tree and multiple pin contacts.

The pin contact tree comprises multiple tabs and multiple longitudinal posts and is removed after installation of the contacts. The tabs are connected to each other. The longitudinal posts are formed respectively on and extend from the tabs.

Each pin contact has a contact lead and a pin socket. The contact leads are formed respectively on and extend transversely from the longitudinal posts and are connected to a PCP after the pin contact tree is removed. Each pin socket comprises a limit, an upper clamp and a lower clamp. The limits are formed respectively on and extend perpendicularly from the contact lead parallel to the longitudinal posts. The upper and lower clamps are formed on the limit and are separated by an interval.

Other objectives, advantages and novel features of the invention will become more apparent from the following detailed description when taken in conjunction with the accompanying drawings.

DETAILED DESCRIPTION OF PREFERRED EMBODIMENT

Figure 1:
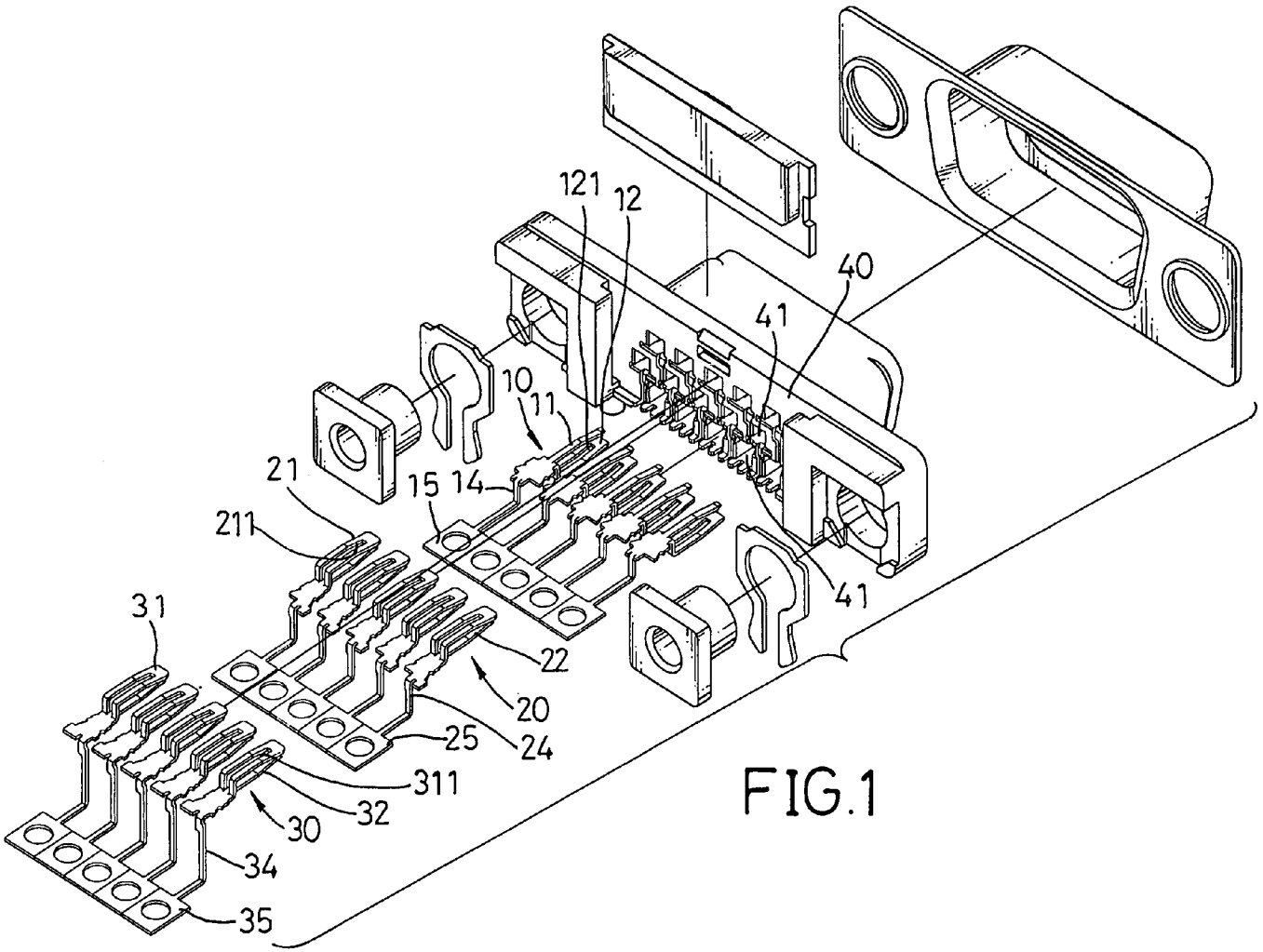
FIG. 1 is an exploded perspective view of a terminal bracket assembly and multiple pin contact installation assemblies for a terminal in accordance with the present invention.

With reference to FIG. 1, a terminal is assembled from a terminal bracket assembly and multiple pin contact installation assemblies (10, 20, 30) in accordance with the present invention.

The terminal bracket assembly has a terminal bracket (40). The terminal bracket (40) has a front, a back and multiple rows of multiple through holes (41). The rows of through holes (41) are defined transversely through the terminal bracket (41). The through holes (41) of each row are defined longitudinally through the terminal bracket (41) and are arranged at intervals.

The pin contact installation assemblies (10, 20, 30) for a terminal comprise a pin contact tree and multiple pin contacts.

The pin contact tree comprises multiple tabs (15, 25, 35) and multiple longitudinal posts. The tabs (15, 25, 35) are connected to each other, are arranged abreast and respectively have a front edge. The longitudinal posts are formed respectively on and extend respectively from the front edges of the tabs (15, 25, 35) and respectively have a distal end.

The pin contacts are arranged abreast and are mounted respectively in adjacent through holes (41) in the same row of the terminal (40), and each pin contact has a contact lead (14, 24, 34) and a pin socket, which are formed integrally with each other.

The contact leads (14, 24, 34) are integrally formed respectively on and extend perpendicular respectively from the distal ends of the longitudinal posts, and each contact lead (14, 24, 34) has a length, a proximal end and a distal end. The proximal ends are formed respectively on the distal ends of the longitudinal posts.

Each pin socket is formed integrally on and extends from the distal end of a corresponding one of the contact leads (14, 24, 34) and has a limit, an upper clamp (11, 21, 31) and a lower clamp (12, 22, 32).

The limit is formed on the distal end of each contact lead (14, 24, 34) and has a proximal edge and a distal edge. The proximal edged is formed on the distal end of the corresponding contact lead (14, 24, 34), and the limit extends perpendicular to the contact lead (14, 24, 34) and parallel to the corresponding longitudinal post.

The upper clamp (11, 21, 31) and the lower clamp (12, 22, 32) of the pin socket are complementary, are formed on the distal edge of the limit, are mounted in a corresponding through hole (41) in the terminal bracket (40) and respectively have distal ends. The distal ends of complementary upper clamps (11, 21, 31) and lower clamp (12, 22, 32) converge to clamp a pin inserted between the distal ends.

Figure 2:
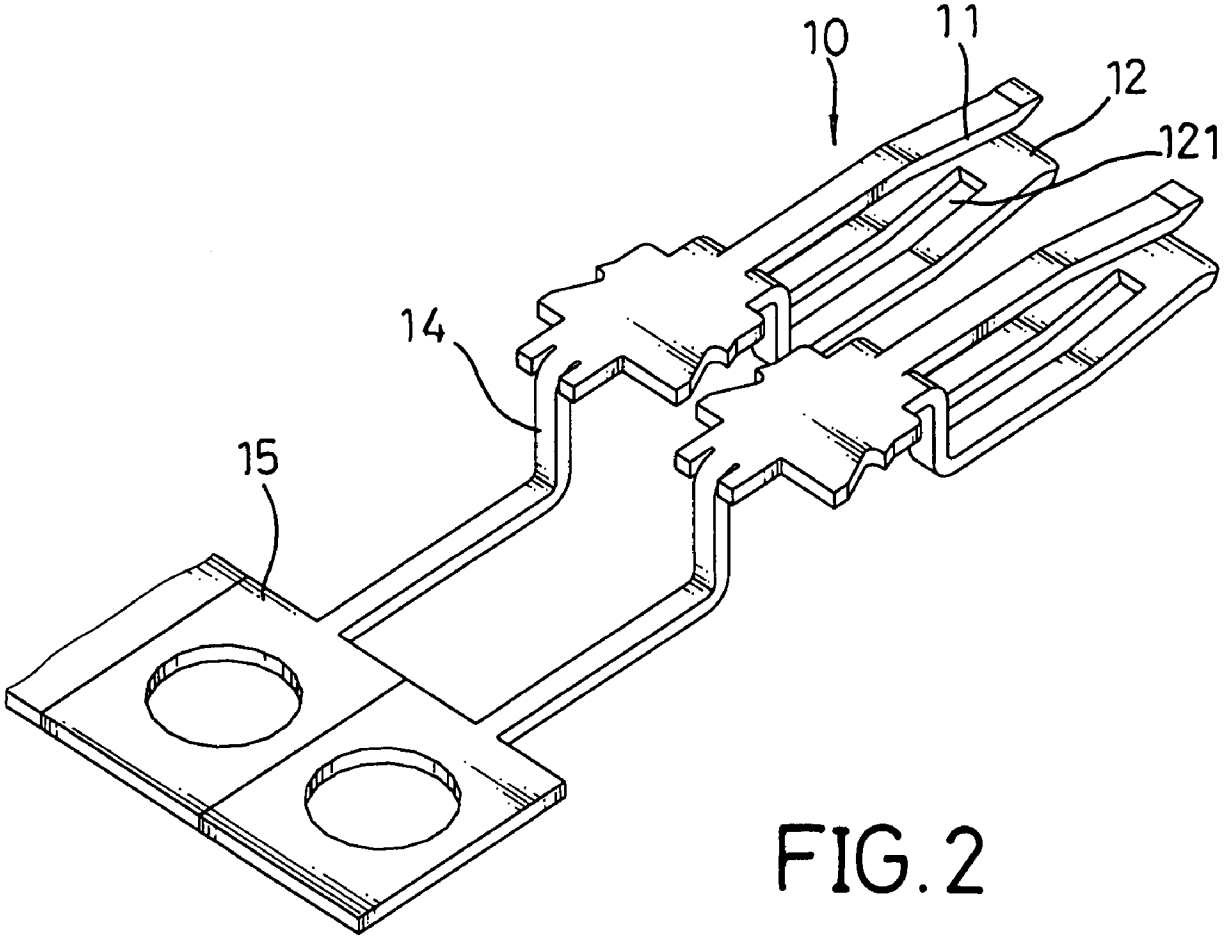
FIG. 2 is an enlarged perspective view of a first embodiment of a pin contact installation assembly in accordance with the present invention.

With further reference to FIG. 2, a first embodiment of a pin contact installation assembly (10) in accordance with the present invention for a terminal has an L-shaped lower clamp (12) with a longitudinal slot (121) from which the upper clamp (11) is formed.

Figure 3:
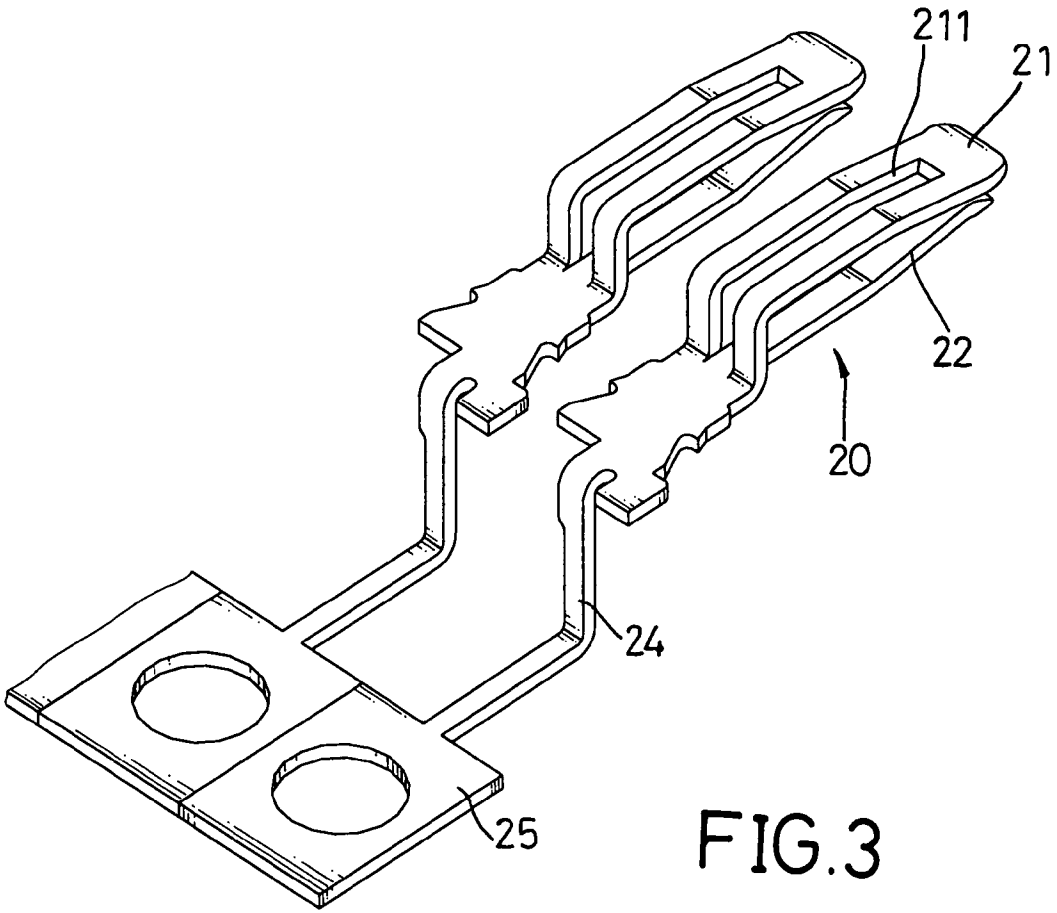
FIG. 3 is an enlarged perspective view of a second embodiment of a pin contact installation assembly in accordance with the present invention.
Figure 4:
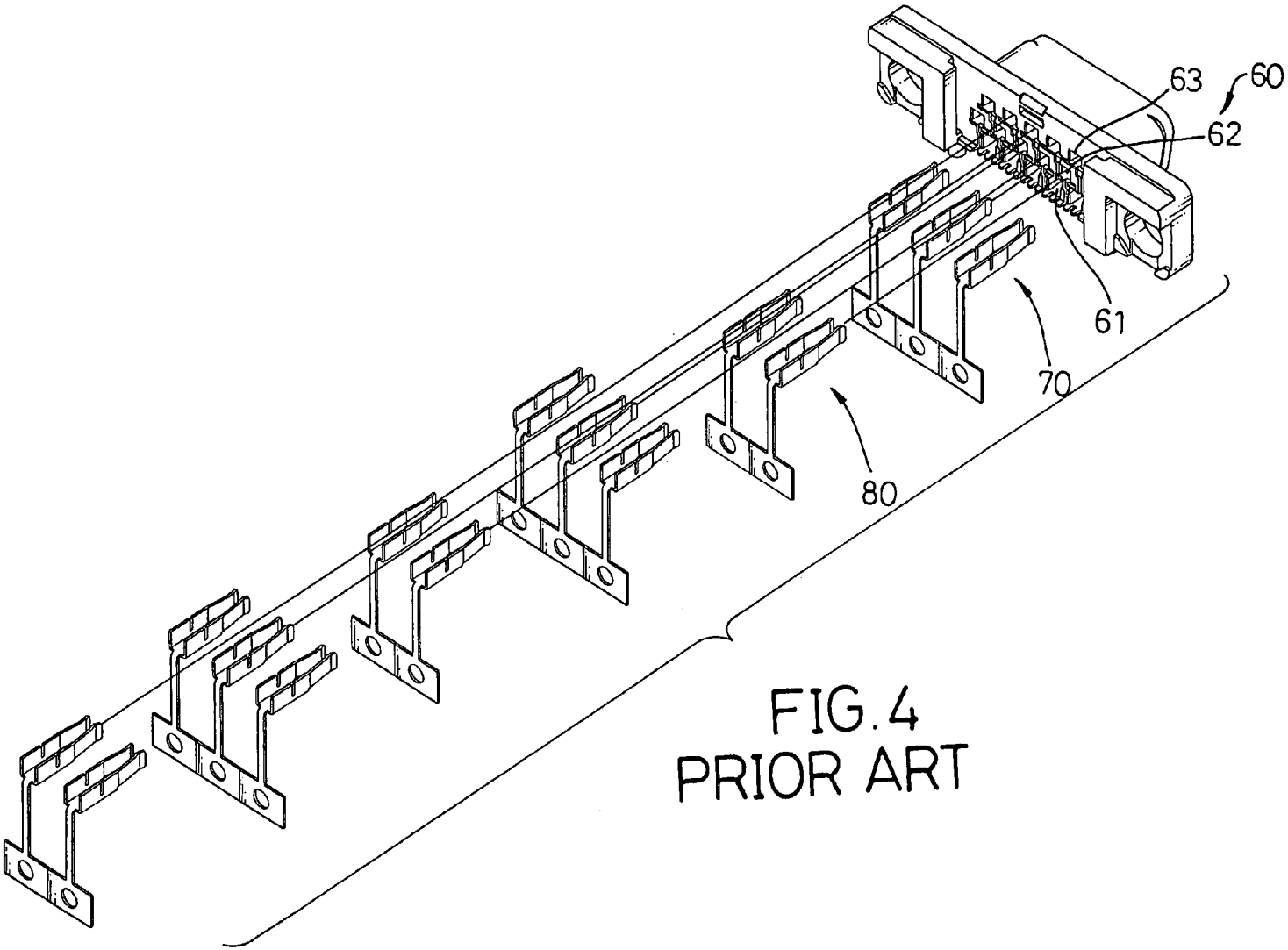
FIG. 4 PRIOR ART
FIG. 4 is an exploded perspective view of a terminal bracket with multiple conventional two and three pin contacts installation assemblies in accordance with the prior art.

With further reference to FIG. 3, a second embodiment of a pin contact installation assembly (20) for a terminal has an L-shaped upper clamp (21) with a longitudinal slot (211) from which the lower clamp (22) is formed. Furthermore, the contact lead (24) is longer than the contact lead (14) in the first embodiment of the pin contact installation assembly (10).

With reference to FIG. 1, a third embodiment of a pin contact installation assembly (30) for a terminal has an L-shaped upper clamp (31) with a longitudinal slot (311) from which the lower clamp (32) is formed. The contact lead (34) is longer than the contact lead (24) in the second embodiment of the pin contact installation assembly (20).

Each pin contact installation assembly (10, 20, 30) is mounted in the back of the terminal bracket (40) with the pin sockets extending respectively into adjacent through holes (41) in the same row.

The assembly of the terminal with the pin contact installation assemblies (10, 20, 30) in accordance with the present invention and the terminal bracket (40) is simple and fast. Therefore, assembly of the terminal is more efficient and saves time.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A pin contact installation assembly for a terminal comprising:

a pin contact tree comprising:

multiple tabs connected to each other, arranged abreast and respectively having a front edge; and multiple longitudinal posts formed respectively on and extending from the front edges of the tabs, and each longitudinal post having a distal end; and multiple pin contacts arranged abreast, and each pin contact having a contact lead integrally formed on and extending perpendicular from the distal end of a corresponding one of the longitudinal posts and having a length, a proximal end formed on the distal end of the longitudinal post and a distal end; and a pin socket integrally formed on and extending from the distal end of a corresponding one of the contact leads and having a limit formed on the distal end of the contact lead, extending perpendicular to the contact lead and parallel to the corresponding longitudinal post and having a proximal edge formed on the distal end of the contact lead and a distal edge;

an upper clamp formed on the distal edge of the limit and having a distal end; and a lower clamp being L-shaped, formed on the distal edge of the limit, complementary to the upper clamp and having a distal end converging with the distal end of the upper clamp and a longitudinal slot from which the upper clamp is formed.

2. A pin contact installation assembly for a terminal comprising:

a pin contact tree comprising:

multiple tabs connected to each other and arranged abreast, and each tab having a front edge; and multiple longitudinal posts formed respectively on and extending respectively from the front edges of the tabs, and each longitudinal post having a distal end; and multiple pin contacts arranged abreast, and each pin contact having a contact lead integrally formed on and extending perpendicular from the distal end of a corresponding one of the longitudinal posts and having a length, a proximal end formed on the distal end of the longitudinal post and a distal end; and a pin socket integrally formed on and extending from the distal end of a corresponding one of the contact leads and having a limit formed on the distal end of the contact lead, extending perpendicular to the contact lead and parallel to the corresponding longitudinal post and having a proximal edge formed on the distal end of the contact lead and a distal edge;

an upper clamp being L-shaped, formed on the distal edge of the limit and has a distal end and a longitudinal slot; and a lower clamp formed from the longitudinal slot on the distal edge of the limit, complementary to the upper clamp and having a distal end converging with the distal end of the upper clamp.

* * * * *